US009573724B2

(12) United States Patent
Mitchell et al.

(10) Patent No.: US 9,573,724 B2
(45) Date of Patent: Feb. 21, 2017

(54) TAB WITH REINFORCED RIVET HOLE, AND TOOLING AND ASSOCIATED METHOD FOR PROVIDING SAME

(75) Inventors: Mark Richard Mitchell, Sidney, OH (US); Craig Allen McEldowney, Russia, OH (US); Robert H. Brussell, New Bremen, OH (US); Gregory H. Butcher, Urbana, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 1799 days.

(21) Appl. No.: 12/642,978

(22) Filed: Dec. 21, 2009

(65) Prior Publication Data

US 2011/0147382 A1 Jun. 23, 2011

(51) Int. Cl.

| | |
|---|---|
| ***B65D 17/34*** | (2006.01) |
| ***B65D 17/00*** | (2006.01) |
| ***B21D 51/38*** | (2006.01) |
| ***B21D 19/08*** | (2006.01) |

(52) U.S. Cl.

CPC ..... *B65D 17/165* (2013.01); *B21D 19/088* (2013.01); *B21D 51/383* (2013.01); *B65D 2517/0014* (2013.01); *Y10T 29/49956* (2015.01); *Y10T 29/5377* (2015.01)

(58) Field of Classification Search

USPC ..... 220/270, 272, 273

See application file for complete search history.

(56) References Cited

U.S. PATENT DOCUMENTS

| | | | | |
|---|---|---|---|---|
| 3,338,463 | A * | 8/1967 | Henrickson | 220/273 |
| 3,437,229 | A | 4/1969 | Khoury | |
| RE27,017 | E * | 12/1970 | Fraze | 220/273 |
| 3,586,203 | A | 6/1971 | Powell | |
| 3,637,106 | A * | 1/1972 | Brown et al. | 220/273 |
| 3,741,141 | A * | 6/1973 | Diekhoff et al. | 413/25 |
| 3,781,972 | A * | 1/1974 | Enjolras et al. | 29/509 |

(Continued)

FOREIGN PATENT DOCUMENTS

| | | |
|---|---|---|
| JP | S58 41047 A | 3/1983 |
| JP | 07-028827 | 5/1995 |
| JP | H07 148532 A | 6/1996 |

OTHER PUBLICATIONS

International Search Report issued Feb. 15, 2011 for International Application No. PCT/US2010/060644.

(Continued)

*Primary Examiner* — Jeffrey Allen

(74) *Attorney, Agent, or Firm* — Eckert Seamans Cherin & Mellott, LLC; Grant E. Coffield

(57) ABSTRACT

A tab is provided, which includes a body having first and second opposing ends, a nose portion disposed at or about the first end of the body, a lift portion disposed at or about the second end of the body of the tab, and a rivet receiving portion disposed proximate the nose portion. The rivet receiving portion includes a generally planar portion, a rivet hole having a perimeter, and an upturned portion extending upwardly from the generally planar portion about the perimeter of the rivet hole. The upturned portion reinforces the rivet hole and has an arcuate cross section profile. An integral rivet extends through the rivet hole and is staked to affix the tab to a can end. The upturned portion is devoid of any corners or edges both before and after the integral rivet is staked.

5 Claims, 6 Drawing Sheets

(56) References Cited

U.S. PATENT DOCUMENTS

| | | | | |
|---|---|---|---|---|
| 4,042,144 | A | 8/1977 | Henning et al. | |
| 4,286,728 | A * | 9/1981 | Fraze et al. | 220/270 |
| 4,301,940 | A * | 11/1981 | Cvacho | 220/269 |
| 4,367,996 | A * | 1/1983 | Saunders | 413/14 |
| 4,424,698 | A | 1/1984 | Langseder | |
| 4,465,204 | A | 8/1984 | Kaminski et al. | |
| 4,596,342 | A | 6/1986 | Zysset | |
| 4,610,156 | A | 9/1986 | Kaminski et al. | |
| 4,773,558 | A * | 9/1988 | Taira et al. | 220/270 |
| 4,815,626 | A | 3/1989 | Yamanashi | |
| 5,715,964 | A * | 2/1998 | Turner et al. | 220/269 |
| 5,741,105 | A | 4/1998 | Schubert et al. | |
| 5,799,816 | A | 9/1998 | Schubert | |
| 6,330,954 | B1 * | 12/2001 | Turner et al. | 220/269 |
| 7,614,520 | B2 | 11/2009 | McEldowney et al. | |
| 2007/0039961 | A1 | 2/2007 | McEldowney et al. | |
| 2008/0078764 | A1 | 4/2008 | McEldowney et al. | |
| 2008/0314906 | A1 | 12/2008 | Butcher et al. | |
| 2009/0095752 | A1 | 4/2009 | McEldowney et al. | |
| 2011/0147382 | A1 * | 6/2011 | Mitchell et al. | 220/270 |

OTHER PUBLICATIONS

English Translation of Japanese Office Action dated Jul. 1, 2014.
European Patent Office, "Supplemental European Search Report," Sep. 7, 2015, 5 pp.
European Patent Office, "Partial Supplemental European Search Report," May 18, 2015, 6 pp.

* cited by examiner

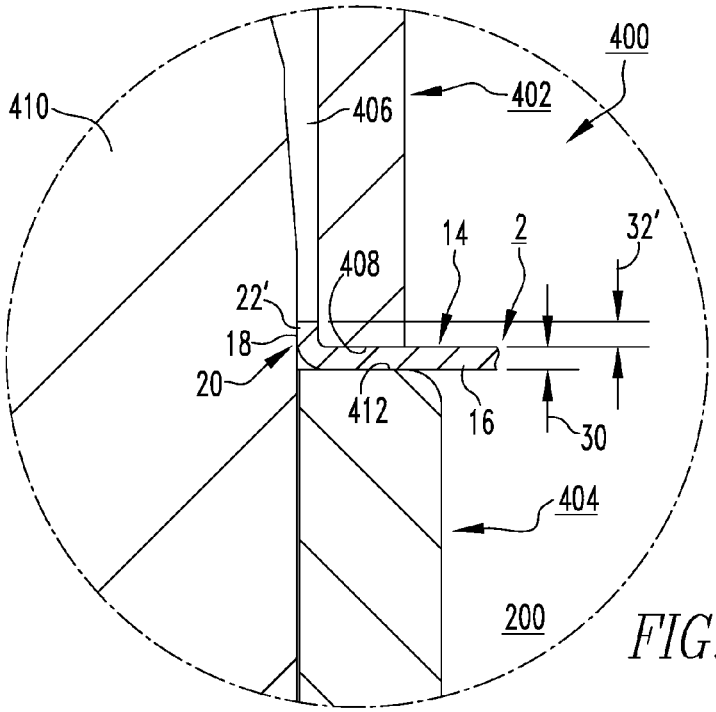
FIG.10
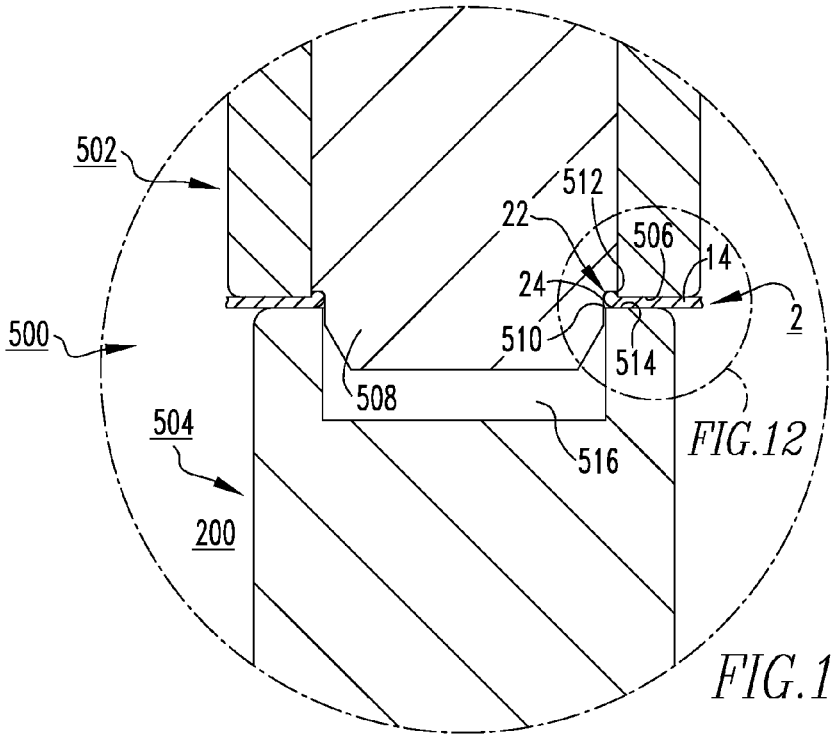
FIG.12
FIG.11

TAB WITH REINFORCED RIVET HOLE, AND TOOLING AND ASSOCIATED METHOD FOR PROVIDING SAME

BACKGROUND

Field

The disclosed concept relates generally to openers for opening containers and, more particularly, to tabs used to open can ends, such as beer/beverage can ends and food can ends. The disclosed concept also relates to can ends having tabs, and to tooling and associated methods for providing such tabs and can ends.

Background Information

A tab is typically secured to a can end by a rivet, and the can end is opened by lifting a lift portion of the tab and pulling upwards so as to pivot the tab about the rivet. Specifically, when the tab pivots after the lift portion of the tab has been lifted upwards, the opposite end (or nose portion) of the tab fractures a score line disposed on the can end, thereby permitting the end-user to access the contents of the can.

In the can making industry, large volumes of metal are required in order to manufacture a considerable number of cans. Thus, an ongoing objective in the industry is to reduce the amount of metal that is consumed. Efforts are constantly being made, therefore, to reduce the gauge (sometimes referred to as "down-gauging") the stock material from which tabs, can ends and can bodies are made. However, as less material (e.g., thinner gauge) is used, problems arise that require the development of unique solutions. By way of example, a common problem associated with efforts to down gauge tab stock material is that the rivet island (i.e., the portion of the tab including a rivet hole through which the rivet is received and staked to secure the tab to the can end) is prone to undesirably elongate or stretch. Consequently, the tab can unintentionally pull off of the rivet when the tab is actuated by a user. In other words, an opening failure occurs as the tab pops off the rivet prior to opening the score aperture of the can end to access the container contents.

There is, therefore, room for improvement in tabs, in can ends, such as beer/beverage can ends and food can ends which employ tabs, and in tooling and methods for providing such tabs and can ends.

SUMMARY

These needs and others are met by embodiments of the disclosed concept, which are directed to a tab for containers (e.g., cans) wherein the tab includes a reinforced rivet hole having an arcuate cross section profile which, among other benefits, strengthens the rivet receiving portion of the tab to resist undesired elongation and associated opening failures, and also avoids rivet scraping and problems associated with the metal exposure that results from rivet scraping.

As one aspect of the disclosed concept, a tab is provided which is structured to be affixed to a can end. The tab comprises: a body including a first end and second end disposed opposite and distal from the first end; a nose portion disposed at or about the first end of the body of the tab; a lift portion disposed at or about the second end of the body of the tab; and a rivet receiving portion disposed proximate the nose portion, the rivet receiving portion comprising a generally planar portion, a rivet hole having a perimeter, and an upturned portion extending upwardly from the generally planar portion about the perimeter of the rivet hole. The upturned portion has an arcuate cross section profile.

As another aspect of the disclosed concept, tooling for making a tab structured to be affixed to a can end, is provided. The tab includes a body having a first end and second end disposed opposite and distal from the first end, a nose portion disposed at or about the first end, a lift portion disposed at or about the second end of the body of the tab, and a rivet receiving portion disposed proximate the nose portion. The tooling comprises: a first tool assembly including a first tool and a second tool disposed opposite the first tool and being structured to cooperate with the first tool to pierce the rivet receiving portion of the tab thereby forming a rivet hole therein, the rivet hole having a perimeter; a second tool assembly including a first tool and a second tool disposed opposite the first tool and being structured to cooperate with the first tool to form an upturned portion extending upwardly about the perimeter of the rivet hole; and a third tool assembly including a first tool and a second tool disposed opposite the first tool and being structured to cooperate with the first tool to reform the upturned portion to have an arcuate cross section profile.

The tooling may further comprise a fourth tool assembly including a first tool and a second tool disposed opposite the first tool and being structured to cooperate with the first tool to stake an integral rivet of the can end, thereby affixing the tab to the can end. The upturned portion of the tab may be devoid of any corners or edges both before and after the integral rivet is staked.

As another aspect of the disclosed concept, a method for making a tab structured to be affixed to a can end, is provided. The method comprises: providing a tab including a body having a first end and second end disposed opposite and distal from the first end, a nose portion disposed at or about the first end, a lift portion disposed at or about the second end of the body of the tab, and a rivet receiving portion disposed proximate the nose portion; piercing the rivet receiving portion of the tab to form a rivet hole, the rivet hole having a perimeter; performing a wipe up operation to initially form an upturned portion extending upwardly about the perimeter of the rivet hole; and performing a coin down operation to reform the upturned portion to have an arcuate cross section profile.

The method may further comprise staking an integral rivet of the can end to affix the tab to the can end. The method may further comprise performing the coin down operation in the opposite direction of the wipe up operation, and reforming the upturned portion may comprise compressing the upturned portion to form the arcuate cross section profile and thereby reinforce the rivet hole. The rivet receiving portion of the tab may include a generally planar portion, and the method may further comprise maintaining the generally planar portion at substantially the same elevation throughout forming process.

BRIEF DESCRIPTION OF THE DRAWINGS

A full understanding of the disclosed concept can be gained from the following description of the preferred embodiments when read in conjunction with the accompanying drawings in which:

FIG. 10 is an enlarged view of a portion of FIG. 7;

FIG. 11 is an enlarged view of a portion of FIG. 8;

DESCRIPTION OF THE PREFERRED EMBODIMENTS

Figure 2:
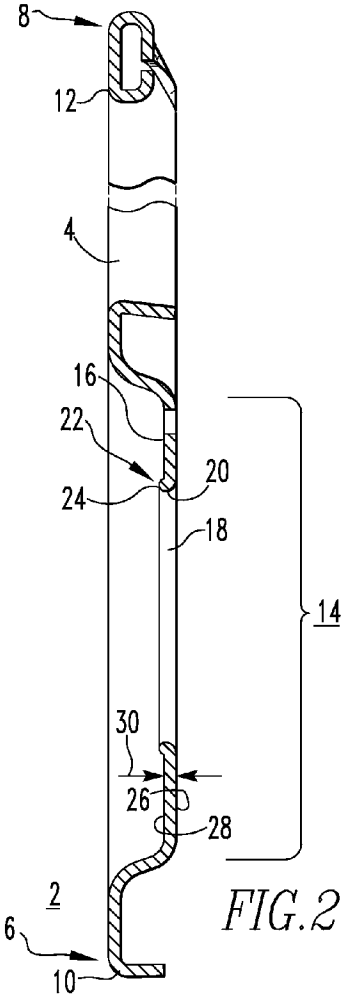
FIG. 2 is a section view taken along line 2-2 of FIG. 1.

For purposes of illustration, embodiments of the disclosed concept will be shown and described as applied to tabs for food container can ends, which are commonly made from steel, although it will become apparent that they could also be applied to tabs made from any other known or suitable material (e.g., without limitation, aluminum) for use with any other known or suitable type of can end and container (e.g., without limitation, can ends for beer/beverage cans).

Directional phrases used herein, such as, for example, up, down, top, bottom and derivatives thereof, relate to the orientation of the elements shown in the drawings and are not limiting upon the claims unless expressly recited therein.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the terms "can" and "container" are used substantially interchangeably to refer to any known or suitable container or can having an end to which the disclosed tab may be coupled.

As used herein, the term "arcuate" shall mean an elliptical or rounded: (i) arc; (ii) arch; (iii) bend; (iv) bow; (v) curve; (vi) radius; and/or (vii) the like that has one or more radii of curvature and which is expressly devoid of any corners or sharp edges.

As used herein, the term "tab" refers to an opening device (e.g., opener) made from generally rigid material that has undergone one or more forming and/or tooling operations, and which is structured to be suitably affixed to a can end for the purpose of being pivoted to sever a score line and open at least a portion of the can end.

As used herein, the term "hemmed" means coined, compressed or otherwise suitably formed to strengthen or reinforce the rivet hole of the disclosed arcuate portion of the tab.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 1:
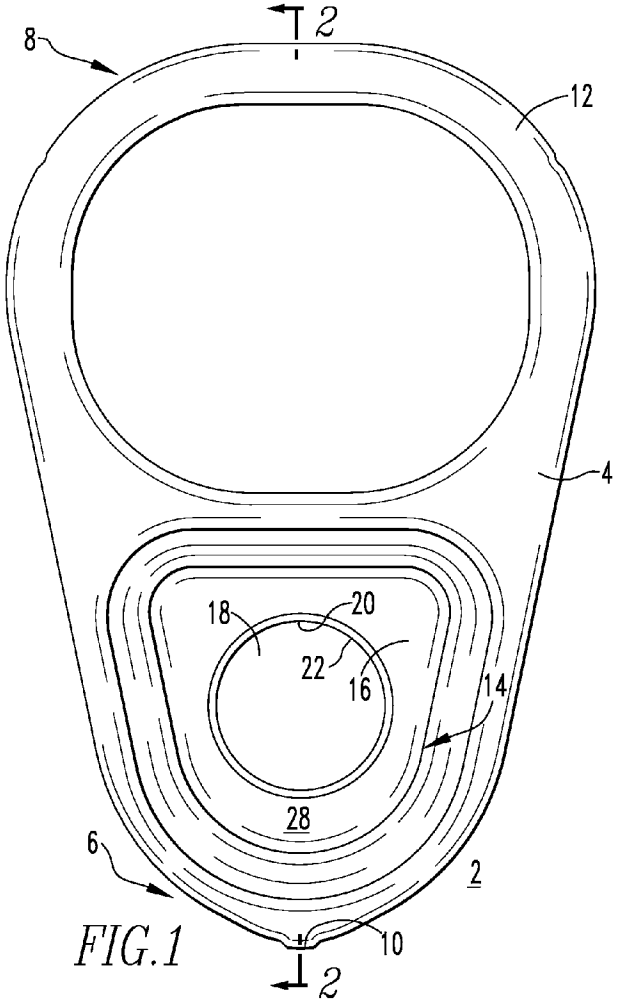
FIG. 1 is a top plan view of a tab in accordance with an embodiment of the disclosed concept.
Figure 9:
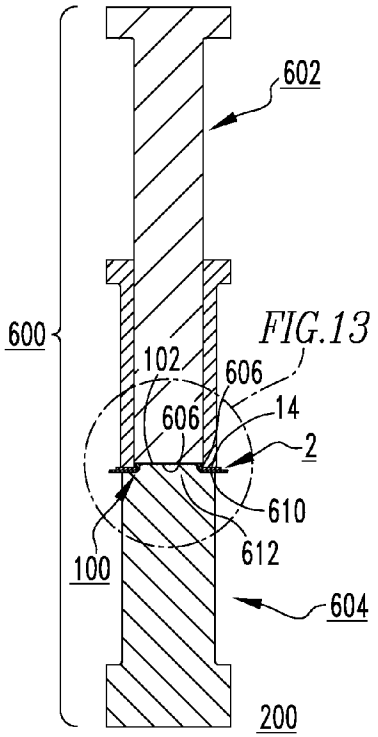
FIGS. 6-9 respectively show four tab forming operations and the corresponding tooling therefor, in accordance with an embodiment of the disclosed concept.

FIGS. 1 and 2 show top plan and side elevation sectional views, respectively, of a tab 2 in accordance with one non-limiting example embodiment of the disclosed concept. The tab 2 includes a body 4 having first and second opposing ends 6,8. A nose portion 10 is disposed at or about the first end 6 of the body 4, and a lift portion 12 is disposed at or about the second end 8. The tab 2 further includes a rivet receiving portion 14, which is disposed proximate the nose portion 10. The rivet receiving portion 14 includes a generally planar portion 16, a rivet hole 18 having a perimeter 20, and an upturned portion 22. The upturned portion 22 extends upwardly from the generally planar portion 16 about the perimeter 20 of the rivet hole 18. As will be described in greater detail hereinbelow, the upturned portion 22 has an arcuate cross section profile 24 (best shown in FIGS. 2, 4 and 11-13). Among other benefits, the arcuate cross section profile 24 functions to strengthen the rivet receiving portion 14 (sometimes referred to as the rivet island), of the tab 2 to resist undesired elongation of the rivet hole 18 and associated opening failure (e.g., the tab 2 prematurely and unintentionally popping off of the rivet (see rivet 102 of FIGS. 4, 5, 9 and 13)) when the tab 2 is actuated and exposed to forces associated with opening the can end 100 (partially shown in FIGS. 4, 9 and 13; see also FIG. 5).

It will be appreciated that this strengthening or reinforcement of the rivet receiving portion 14 about the perimeter 20 of the rivet hole 18, in turn, advantageously permits the thickness or gauge 30 (FIGS. 2, 10 and 12) of the stock material (e.g., without limitation, aluminum; steel) from which the tab 2 is made to be reduced. Such reduction in thickness or gauge 30 is commonly referred to in the art as "down-gauging" and can result in substantial cost savings, because less material is required to make the tab 2. By way of example and without limitation, in instances in which the tab 2 is made from steel stock material, in accordance with the disclosed concept, the thickness 30 of the steel stock material can be down-gauged from a typical thickness of about 0.014 inch to about 0.012 inch, to a thickness 30 of less than about 0.012 inch, for example, as thin as 0.010 inch, or less. Similarly, when the tab 2 in accordance with the disclosed concept is made from aluminum stock material, for example for aluminum beer/beverage applications, the aluminum stock material can be down-gauged from a typical thickness of about 0.011 inch to a thickness or gauge 30 of less than about 0.011 inch, to as thin as 0.009 inch, or less. It will, therefore, be appreciated that the disclosed concept enables the thickness or gauge 30 of the stock material from which the tab 2 is made to be reduced or down-gauged by virtue of the fact that the upturned portion 22 of the tab 2 strengthens or reinforces the rivet hole 18, thereby allowing the tab 2 to have sufficient strength when made from material of a thinner gauge 30. Such down-gauging advantageously results in substantial material cost savings, thereby reducing the overall cost to manufacture the tab 2. This, in turn, translates to a reduction in the cost of the cans or containers which employ the tab 2. An additional benefit of the upturned portion 22 and, in particular, the arcuate cross section profile 24 thereof, is the fact that such profile 24 is rounded (e.g., without limitation, includes one or more radii of curvature). That is, the upturned portion 22 is smooth or devoid of any corners or relatively sharp edges. This is true both before (see FIGS. 2, 8, 11 and 12) and after (FIGS. 4, 5 and 13) the tab 2 is affixed to the can end 100.

More specifically, the can end 100 preferably includes an integral rivet 102, wherein to affix the tab 2 to the can end 100, the tab 2 is placed over the rivet 102 such that the rivet 102 extends through the rivet hole 18 and is subsequently staked in order to affix the tab 2 to the can end 100, as shown in FIGS. 4, 5, 9 and 13. The smooth, arcuate cross section profile 24 of the upturned portion 22 of the tab 2 enables the tab 2 to slide over and downward along the rivet 102, without undesirably scraping it. Rivet scraping, which is associated for example with corners or relatively sharp edges of known rivet holes, scratches or cuts through protective coatings (not shown) undesirably causing metal exposure and problems which are generally known to be associated therewith. Prior proposals attempting to address rivet scraping have involved, for example, bending back or curling material (not shown) about the rivet hole. However, relatively sharp corners (not shown) remained at or about the upward edge (not shown and/or relatively sharp corners were created during the subsequent rivet staking operation when the curl of the rivet hole was compressed. The arcuate cross section profile 24 of the upturned portion 22 of the disclosed concept remains rounded and smooth throughout the rivet staking operation, and afterwards, thus overcoming the rivet scraping disadvantages associated with the prior art.

Figure 4:
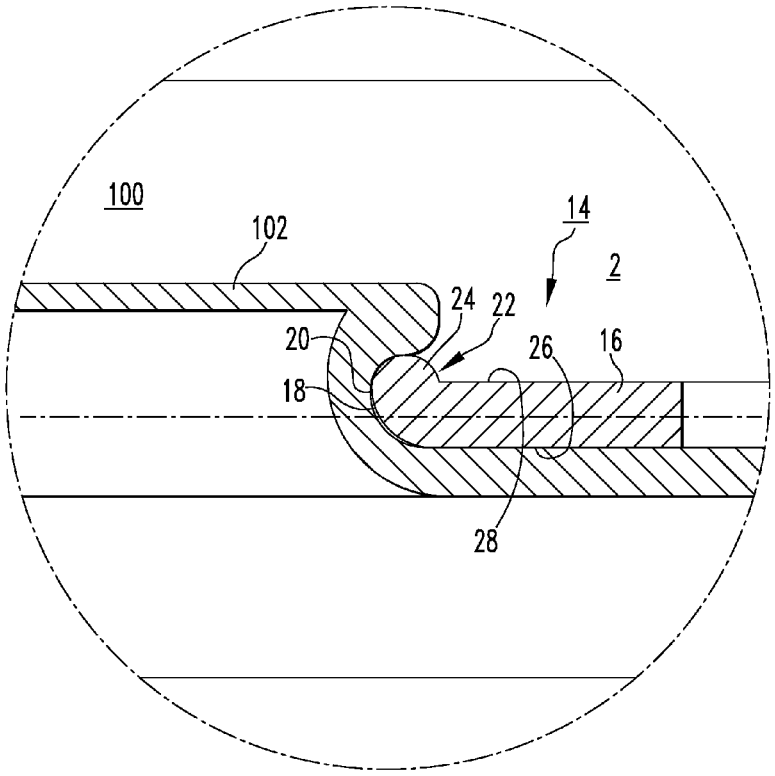
FIG. 4 is an enlarged section view of the tab and rivet hole therefor, shown after a subsequent forming operation and after the integral rivet of a can end has been inserted through the rivet hole and staked to affix the tab to the can end.
Figures 4, 5:
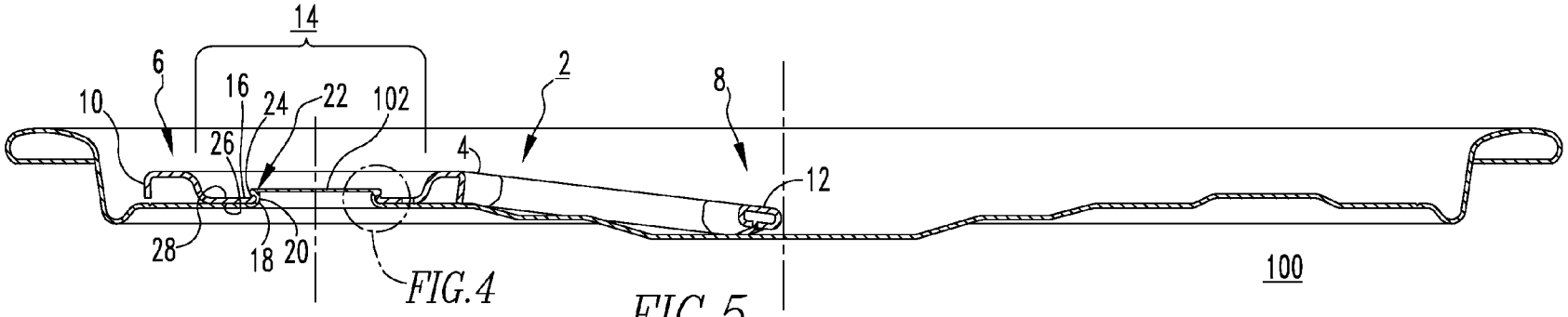
FIG. 5 is a side elevation sectional view of the can end and tab of FIG. 4.
Figure 12:
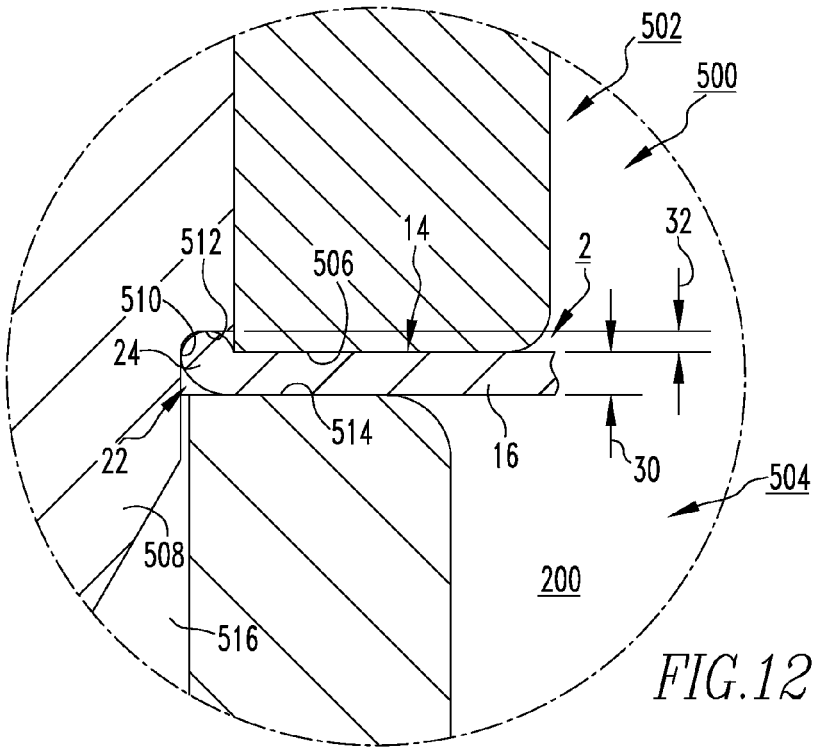
FIG. 12 is an enlarged view of a portion of FIG. 11.
Figure 13:
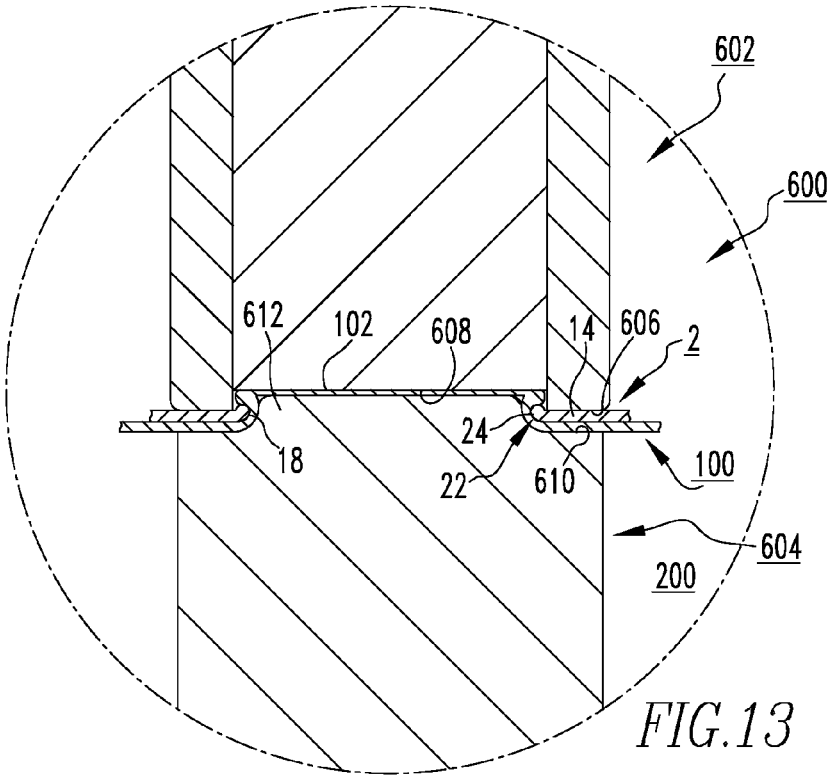
FIG. 13 is an enlarged view of a portion of FIG. 9.

The arcuate cross section profile 24 is best shown in FIGS. 2 and 12, which show the upturned portion 22 of the tab 2 after final forming but before being staked to the can end 100 (FIGS. 4, 5, 9 and 13) by the integral rivet 102 (FIGS. 4, 5, 9 and 13), and FIGS. 4 and 13, which show the upturned portion 22 of the tab 2 after the tab 2 has been staked to the can end 100. It will be appreciated with reference to these figures that the arcuate cross section profile 24 of the upturned portion 22 is maintained both before and after the tab 2 has been affixed to the can end 100. In the example shown and described herein, the generally planar portion 16 of the rivet receiving portion 14 of the tab 2 has a first surface 26 (e.g., bottom surface from the perspective of FIG. 4) and a second surface 28 (e.g., top surface from the perspective of FIG. 4) disposed opposite the first surface 26. The arcuate cross section profile 24 of the upturned portion 22 preferably extends from the first surface 26 to the second surface 28, as shown. It will, however, be appreciated that any known or suitable alternative cross section profile, for example having any known or suitable alternative number, shape and/or configuration of radii of curvature, could be employed to suitably reinforce the rivet hole 18 and resist rivet scraping in accordance with the disclosed concept.

Tooling 200 and associated methods for making the tab 2 will now be described with reference to (FIGS. 6-13). It will be appreciated that the tooling 200 may be coupled to dies, which are in turn coupled to a conversion press in a generally well known manner. The conversion press and dies are not expressly shown herein for simplicity of illustration and economy of disclosure. It will further be appreciated that the tooling 200 and associated forming steps or processes described herein may be employed in any known or suitable number and/or configuration of tooling stations in the conversion press, where each station generally includes one or more tools and each of the tools performs a tooling operation on the material. While a limited number of stations are shown and described herein, it will be appreciated that the method of making the tab 2 in accordance with the disclosed concept could include numerous other known or suitable stations not depicted herein. It will further be appreciated that each of the stations could be located (e.g., without limitation, housed) in separate machine housings, in a single machine housing, or in any combination thereof. Finally, it will be appreciated that the stock material from which the tabs 2 are made can by conveyed through the conversion press by any known or suitable means. Typically, the material is fed into the conversion press as sheets or is uncurled and then fed into the conversion press and conveyed through the tooling stations as a solid sheet until tooling operations have been performed on the material to form a plurality of separate tabs 2, as desired.

Figure 3:
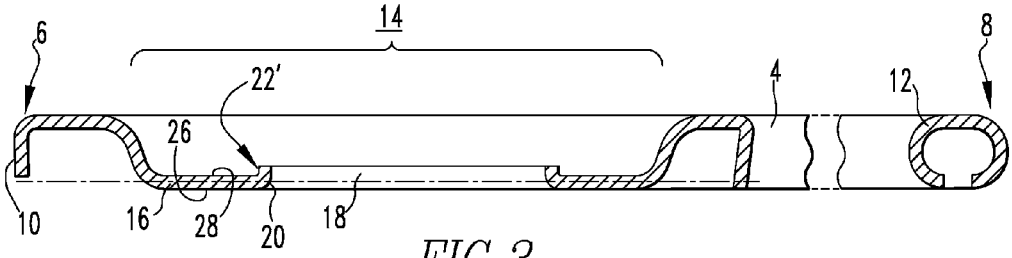
FIG. 3 is a section view of a tab and a rivet hole therefor after an initial forming operation in accordance with an embodiment of the disclosed concept.
Figure 6:
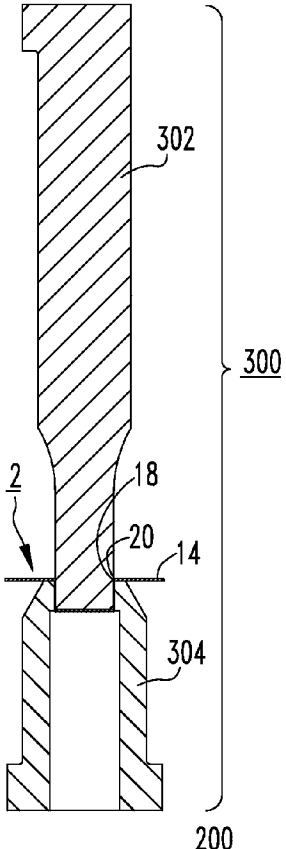

In accordance with the disclosed concept, forming the reinforced or hemmed rivet hole 18 generally involves four forming operations; a piercing operation, a wipe up operation, a coin down operation, and a staking operation, which are shown in FIGS. 6, 7, 8 and 9, respectively. In the piercing operation, the rivet receiving portion 14 of the tab 2 is introduced to a first tool assembly 300 having a first tool 302 and a second tool 304 disposed opposite from, and being structured to cooperate with, the first tool 302, as shown in FIG. 6. Specifically, the first tool is a punch 302 and the second tool is a die 304, wherein the rivet receiving portion 14 of the tab 2 is first introduced between the punch 302 and die 304, and the punch 302 is then advanced to pierce through the rivet receiving portion 14 moving into the die 304 to remove (e.g., punch out) material to form the rivet hole 18, which has a perimeter 20. Next, the rivet receiving portion 14 of the tab 2 is introduced to a second tool assembly 400 to perform the wipe up operation, shown in FIGS. 7 and 10. Specifically, the second tool assembly 400 includes a first tool 402 having a recessed portion 406 and a first shoulder 408. A second tool 404 disposed opposite from, and being cooperable with, the first tool 402, includes a tapered protrusion 410 and a second shoulder 412. In operation, the first shoulder 408 of the first tool 402 cooperates with the second shoulder 412 of the second tool 404 to secure the rivet receiving portion 14 of the tab 2 therebetween. The tapered protrusion 410 of the second tool 404 is then advanced to extend into the recessed portion 406 of the first tool 402. As it does so, the wipe up operation is performed, wherein the material of the tab 2 about the perimeter 20 of the rivet hole 18 is bent upward between the tapered protrusion 410 of the second tool 404 and the first shoulder 408 of the first tool 402, as best shown in FIG. 10. The cross section of the tab 2 after the wipe up operation, but prior to the coin down operation (described hereinbelow), is shown in FIG. 3. In other words, the wipe up operation functions to initially form the upturned portion 22' (FIGS. 3 and 10) of the tab 2. It will be appreciated that it is important to establish the proper dimensions during the wipe up operation, in particular the height 32' of the upturned portion 22', because among other things, the height 32' of the upturned portion 22' will affect whether or not the subsequent coin down operation (described hereinbelow) can be properly performed. Preferably, after the wipe up operation, the upturned portion 22' extends above the generally planar portion 16 of the tab 2 a height 32' of less than 1.5 times the thickness 30 of the generally planar portion 16.

Figure 8:
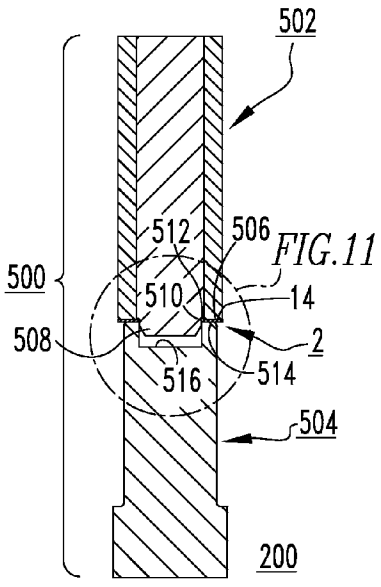
Figure 7:
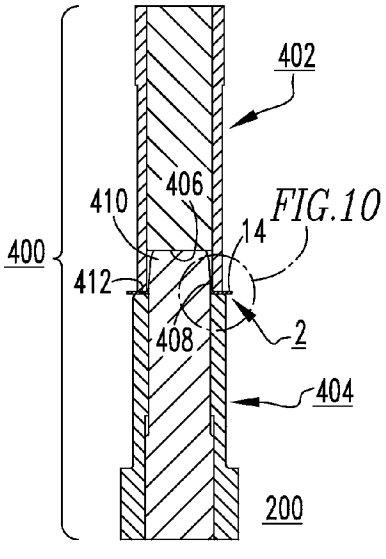

Following the wipe up operation, the tab 2 is next introduced to a third tool assembly 500 where the coin down operation is performed, as shown in FIGS. 8, 11 and 12. Specifically, the third tool assembly 500 includes a first tool 502 having a third shoulder 506, and a projection 508 with an annular recessed portion 510 having an edge 512. A second tool 504 is disposed opposite from, and is cooperable with, the first tool 502 and includes a fourth shoulder 514 and a cavity 516. In operation, the third shoulder 506 of the first tool 502 cooperates with the fourth shoulder 514 of the second tool 504 to secure the rivet receiving portion 14 of the tab 2 therebetween. The projection 508 of the first tool 502 then extends into the cavity 516 of the second tool 504, thereby compressing the upturned portion 22 of the tab 2 between the edge 512 of the annular recessed portion 510 of the projection 508 of the first tool 502 and the fourth shoulder 514 of the second tool 504. In this manner, the coin down operation is completed to reform the upturned portion 22 of the tab 2 and provide the desired arcuate cross section profile 24 thereof. It is this final coin down forming operation of the upturned portion 22 and, in particular, the arcuate cross section profile 24 thereof, which forms the hemmed rivet hole 18 to strengthen the rivet hole 18 and reduce elongation or stretching thereof during can opening operations. The height 32 (FIG. 12) of the finished hemmed or upturned portion 22 is important as it affects the ability to subsequently achieve the proper finished staking operation (described hereinbelow) and, in particular, the desired finished rivet diameter. Specifically, achieving the desired finished rivet diameter is important, because it is the overlapping material of the rivet 102, which retains the finished tab 2 on the can end 100, as best shown in FIGS. 4 and 13. If the finished hemmed height (e.g., height 32 of the upturned portion 22, after completion of the coin down operation) is too high, then insufficient overlap of the rivet 102 over the tab rivet receiving portion 14 will occur, because the proper rivet diameter cannot be achieved. In addition, relatively sharp edges (not shown) can develop during the staking operation, for example in the base radius (e.g., portion near bottom surface 28 (FIGS. 2-4)) of the upturned portion 22, which would undesirably result in rivet scraping and metal exposure of the rivet 102, as previously discussed. It will be appreciated that a disclosed upturned portion 22 and, in particular, the arcuate cross section profile 24 thereof, is completely devoid of any corners or sharp edges not only after the aforementioned coin down operation, but also after the rivet staking operation (discussed hereinbelow). Preferably, after completion of the coin down operation, the upturned portion 22 of the tab 2 extends above the generally planar portion 16 of the rivet receiving portion 14 a height 32 of less than 1.0 times the thickness 30 of the generally planar portion 16, as shown in FIG. 12. The section view of FIG. 2 shows the completed tab 2 after completion of the foregoing coin down operation, but prior to being affixed to the can end 100 (FIGS. 4, 5, 9 and 13).

Although not a required step for making a tab 2 in accordance with the disclosed concept, it is intended that the tab 2 will be suitably affixed to a can end 100 (FIGS. 4, 5, 9 and 13). For example and without limitation, this is commonly achieved by staking an integral rivet 102 of the can end 100, such that the rivet 102 is compressed and expanded outwardly to overlap a portion of the tab 2 about the rivet hole 18, thereby securing the tab 2 to the can end 100. Specifically, after the completed tab 2 has been placed over the integral rivet 102 of the can end 100, the can end 100/tab 2 assembly is introduced to a fourth tool assembly 600. The fourth tool assembly 600 includes a first tool 602 having a fifth shoulder 606 and a recess 608. A second tool 604, which is disposed opposite from and structured to be cooperable with, the first tool 602, includes a sixth should 610 and an extension 612. As best shown in the enlarged view of FIG. 13, the rivet staking operation involves advancing at least one of the first tool 602 and second tool 604 toward the other of the first tool 602 and second tool 604 until the planar surface of the recess 608 of the first tool 602 compresses the integral rivet 102 against the extension 612 of the second tool 604, thereby deforming the material of the integral rivet 102 and driving it laterally outwardly to overlap the upturned portion 22 of the hemmed rivet hole 18, as shown. In this manner, a predetermined desired diameter of the staked rivet 102 is achieved to securely affix the tab 2 to the can end 100. As shown in FIG. 13, the upturned portion 22 and, in particular, the arcuate cross section profile 24 thereof, remains rounded or smooth (e.g., without limitation, devoid of any relatively sharp corners or edges) throughout the aforementioned rivet staking operation and afterwards. Thus, as previously discussed, rivet scraping and disadvantages associated therewith, are avoided. Additionally, as shown for example in FIGS. 3-5, it will be appreciated that the generally planar portion 16 of the tab 2 maintains substantially the same elevation and is substantially flat (see, for example, the reference axis shown in FIGS. 3 and 4) throughout the aforementioned tab forming and staking process. This further contributes to ensuring that a proper and effective relationship between the tab 2 and the can end 100 is achieved.

Accordingly, the disclosed concept provides a tab 2 having a rivet hole 18 that is reinforced (e.g., hemmed) by an upturned portion 22, which strengthens the tab 2 to resist undesired elongation and associated opening failures. This, in turn, enables down-gauging of the stock material from which the tab 2 is made. Additionally, the upturned portion 22 of the hemmed rivet hole 18 has and maintains an arcuate cross section profile 24 throughout the rivet staking operation, and afterwards, which avoids undesirable rivet scraping 102.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A tab structured to be affixed to a can end, the tab comprising:

a body including a first end and second end disposed opposite and distal from the first end;

a nose portion disposed at or about the first end of the body of the tab;

a lift portion disposed at or about the second end of the body of the tab; and a rivet receiving portion disposed proximate the nose portion, the rivet receiving portion comprising a generally planar portion including a rivet hole having a perimeter, the rivet receiving portion being turned upward about the perimeter to define an upturned portion extending upwardly from the generally planar portion about the perimeter of the rivet hole, wherein the generally planar portion has a bottom surface and a top surface disposed opposite the bottom surface, and wherein the upturned portion is completely rounded and smooth from the bottom surface to the top surface wherein the can end includes an integral rivet; and wherein the integral rivet of the can end is structured to extend through the rivet hole and to be staked in order to affix the tab to the can end; and wherein the generally planar portion of the rivet receiving portion has a thickness; and wherein, after final forming of the tab, the upturned portion extends above the generally planar portion a height of less than 1.0 times the thickness of the generally planar portion.

2. The tab of claim 1 wherein the upturned portion has an arcuate cross section profile; and wherein the arcuate cross section profile of the upturned portion extends from the bottom surface to the top surface.

3. The tab of claim 1 wherein the tab is a steel tab made from steel stock material; wherein the steel stock material has a thickness; and wherein the thickness of the steel stock material is less than about 0.012 inch.

4. The tab of claim 1 wherein the tab is an aluminum tab made from aluminum stock material; wherein the aluminum stock material has a thickness; and wherein the thickness of the aluminum stock material is less than about 0.011 inch.

5. The tab of claim 1 wherein the upturned portion is devoid of any corners or edges both before and after the integral rivet is staked to affix the tab to the can end.

* * * * *